US006079241A

United States Patent [19]

Burleigh et al.

[11] Patent Number: 6,079,241

[45] Date of Patent: Jun. 27, 2000

[54] METHOD AND APPARATUS FOR LOCK MOUNTING

[75] Inventors: Charles E. Burleigh, Salem; Matthew S. Hill, Sublimity, both of Oreg.

[73] Assignee: SLC Technologies, Inc., Salem, Oreg.

[21] Appl. No.: 09/067,356

[22] Filed: Apr. 27, 1998

[51] Int. Cl.[7] ..... E05B 9/08

[52] U.S. Cl. ..... 70/370; 70/451

[58] Field of Search ..... 70/370–372, 416, 70/417, 450, 451, 466; 292/DIG. 53

[56] References Cited

U.S. PATENT DOCUMENTS

| | | | |
|---|---|---|---|
| 4,381,656 | 5/1983 | Hayakawa | 70/370 X |
| 4,489,577 | 12/1984 | Crepinsek | 70/370 X |
| 4,873,850 | 10/1989 | Lyons et al. | 70/370 X |
| 4,873,852 | 10/1989 | Neyret | 70/370 X |
| 4,910,982 | 3/1990 | Dana | 70/370 |
| 5,251,467 | 10/1993 | Anderson | 70/370 |
| 5,297,405 | 3/1994 | Manning et al. | 70/370 X |
| 5,410,899 | 5/1995 | McConnell | 70/370 |
| 5,435,159 | 7/1995 | Ramsauer | 70/370 |
| 5,479,800 | 1/1996 | Myers | 70/370 X |
| 5,548,981 | 8/1996 | Kirk | 70/370 X |
| 5,636,540 | 6/1997 | Myers | 70/370 |

*Primary Examiner*—Suzanne Dino Barrett
*Attorney, Agent, or Firm*—Klarquist Sparkman Campbell Leigh & Whinston, LLP

[57] ABSTRACT

A lock includes a face plate into which a lock cylinder is mounted. Extending from the rear side of the face plate is a frame for supporting the back of the lock cylinder. A cover plate covers the front of the lock cylinder and includes one or more arms extending through the face plate to the back thereof, where the arms are secured against the plate. By this arrangement, the cover plate is secured to the back of the face plate, preventing removal of the lock cylinder by prying. The frame secures the lock cylinder to the rear, preventing it from being dislodged by hammer blows. Against all such attacks, the full structural integrity of the face plate serves to keep the lock cylinder in place and the lock secure.

6 Claims, 2 Drawing Sheets

METHOD AND APPARATUS FOR LOCK MOUNTING

FIELD OF THE INVENTION

The present invention relates to locks, and more particularly relates to methods and apparatuses for simply, yet securely, mounting locks in housings.

BACKGROUND AND SUMMARY OF THE INVENTION

Much effort has been put into the development of secure lock cylinders. Various pin and tumbler arrangements have been devised to resist picking and other attacks. However, a lock cylinder is no more secure than the housing into which it is mounted, and the means employed to mount the lock within the housing.

Prior art techniques for mounting lock cylinders in locks are shown in FIGS. 1 and 2. In FIG. 1, a lock cylinder 10 is received in a cavity formed by walls 12 that extend back from the face plate 14. A pin 16 on the back of the lock cylinder 10 engages a bolt 18 and serves to extend or retract the bolt.

While relatively secure at the back, the front of the FIG. 1 lock cylinder is held in place only by a swaged cover member 20 that is force-fit into an opening in the front of the face plate 14. This lock can be jimmied simply by prying out the swaged cover member 20, permitting removal of the lock cylinder 10 and free manipulation of the bolt 18.

A different, but equally unsatisfactory, arrangement is shown in FIG. 2. In this class of prior art, the lock cylinder 10 is mounted in a threaded housing 22 that has a flange 24 at the front and a nut 26 at the back. The cooperation of the front flange 24 with the nut 26 permits this lock cylinder housing to be secured to the face plate 14. However, the security of the lock rests entirely on the strength of the flange 24, and its engagement with the face plate adjacent thereto. By applying forceful hammer blows directly to the front face 29 of the lock cylinder 10, the flange 24 of the housing 22 can be broken off, or the face plate against which it is engaged can be deformed or broken, permitting the lock cylinder to driven into the locked housing, opening same.

In accordance with a preferred embodiment of the present invention, the foregoing and other drawbacks of the prior art are overcome, resulting in an lock mounting arrangement that is resistant to both prying and hammer attacks.

An illustrative embodiment includes a lock cylinder, a face plate, and a lock cylinder cover. Like the FIG. 1 prior art, the face plate forms a cavity into which the lock cylinder is positioned. The back of the face plate forms a frame covering the back of the lock cylinder. However, instead of covering the front opening with a swaged member, the cylinder is covered by a cover that includes at least one arm member passing through the face plate to the back. A fastener secures this arm against the back of the face plate. By this arrangement, the front cylinder cover is secured to the back of the face plate, preventing its removal by prying. The frame secures the cylinder to the rear, preventing it from being dislodged by hammer blows. Against all such attacks, the full structural integrity of the face plate serves to keep the lock cylinder in place and the lock secure.

The foregoing and additional features and advantages of the present invention will be more readily apparent from the following detailed description, which proceeds with reference to the accompanying drawings.

DETAILED DESCRIPTION

Figure 1:
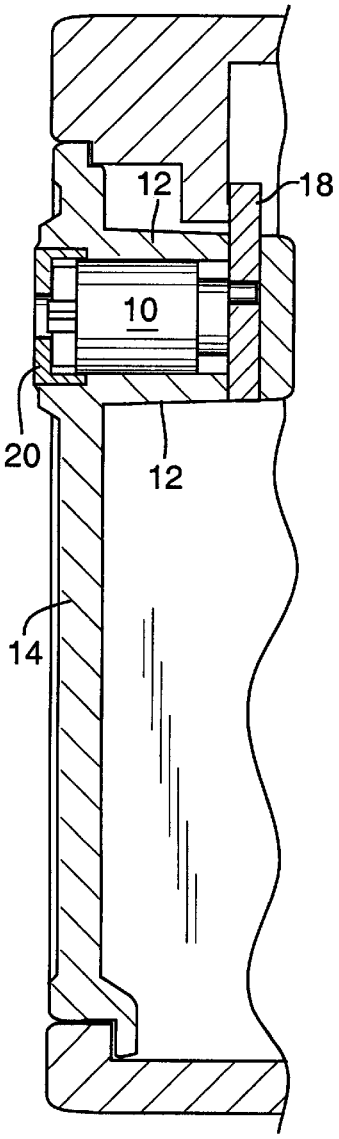
FIG. 1 PRIOR ART
FIGS. 1 and 2 show prior art approaches for mounting a lock cylinder in a lock face plate.
Figure 2:
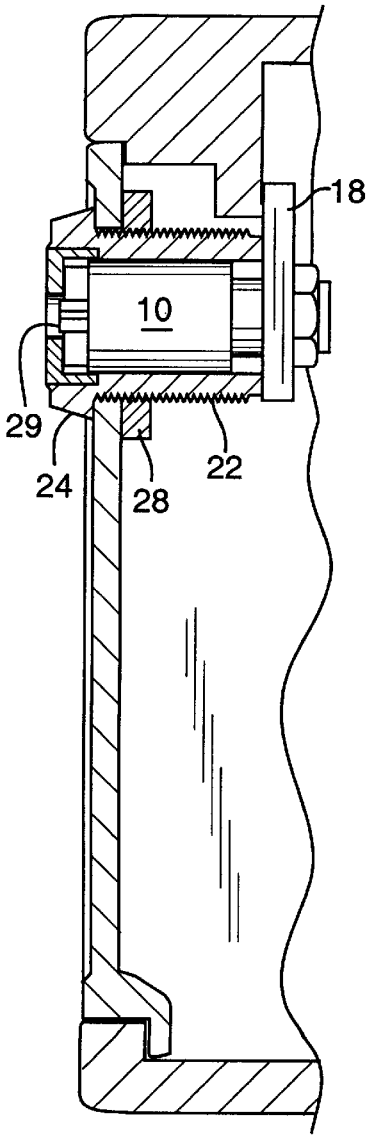
FIG. 2 PRIOR ART
Figure 3:
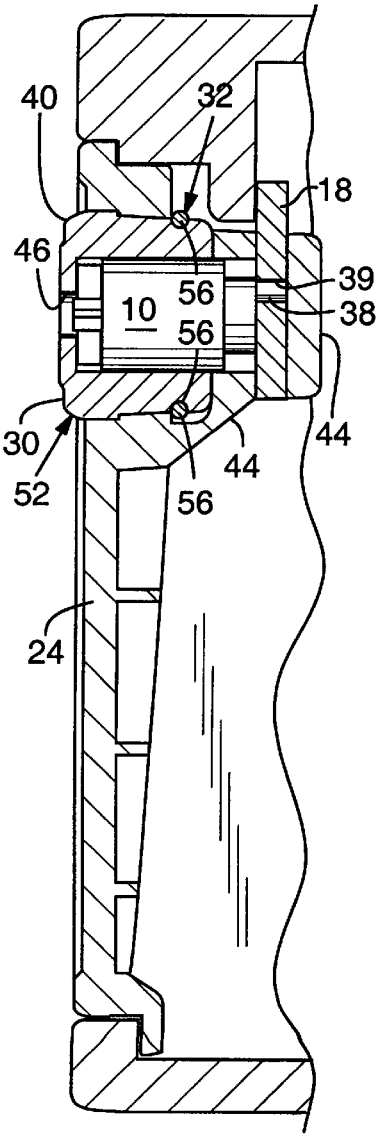
FIG. 3 shows a lock cylinder mounting arrangement according to one embodiment of the present ivention.
Figure 4:
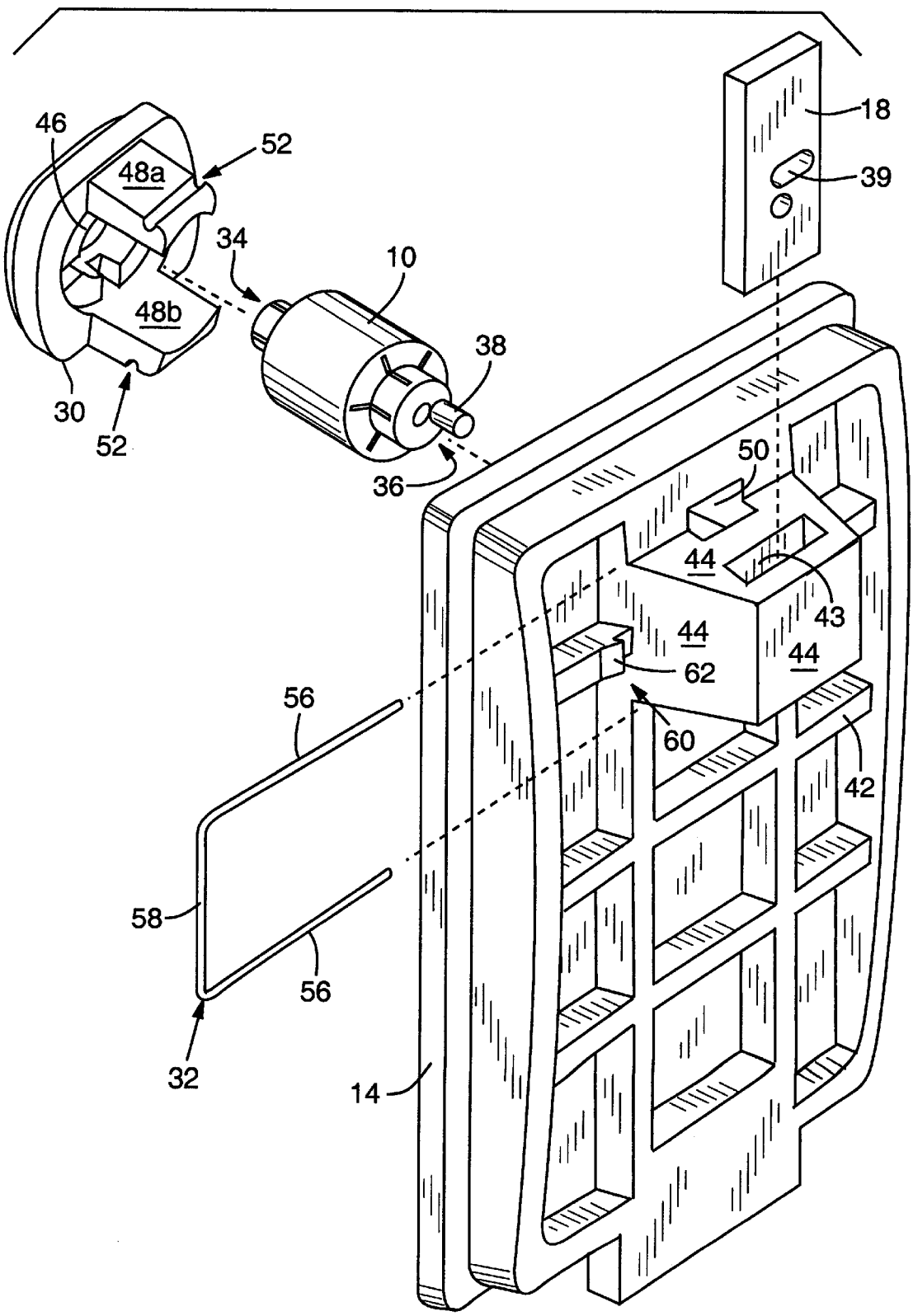
FIG. 4 is an exploded view showing the lock cylinder mounting arrangement of FIG. 3.

Referring to FIGS. 3 and 4, an illustrative embodiment of the present invention includes a lock cylinder 10, a face plate 14, a cover member 30, and a fastener 32.

Cylinder 10 is conventional and its design is thus not belabored. The cylinder has a front 34 with an opening to receive a key (not shown) and a back 36. From the rear protrudes an actuator pin 38. The actuator pin 38 engages a slot 39 in a bolt 18, permitting extension and retraction of the bolt.

The face plate 14 has an opening 40 at the front. Extending from the back 42 of the face plate are wall members 44 defining a frame. Inside this frame is a cavity in which the lock cylinder 10 is positioned. The frame serves to cover the back 36 of the cylinder. The frame also includes slots 43 securing the bolt while permitting sliding motion thereof.

Cover member 30 is received in the opening 40 in the face plate and is positioned over the front 34 of the cylinder. An opening 46 in the cover member permits the key to engage the front 34 of the cylinder 10. Protruding back from the cover member 30 are first and second arms 48*a*, 48*b*. The distal portions of these arms pass through passageways in the face plate terminating in openings 50 in the back of the face plate. These arms are sized so that when the cover member is fully pressed into the front of the face plate, slots 52 on the distal portions just barely protrude out the openings 50. There these slots (and thereby the cover member) are held in place by the fastener clip 32.

As shown in FIG. 4, fastener clip 32 includes two legs 56 and an arm 58 therebetween. When the cover member is fully pressed into the front of the face plate, the clip's legs are slid into the slots 52 in arms 48, preventing the arms (and the cover member) from being withdrawn from the face plate.

Included on the back of the face plate is a feature 60 that secures clip 54 in place against movement. The illustrated feature 60 is a nib that protrudes from the back of the face plate and includes an inclined surface 62. The inclined surface permits the arm to slide up and over the nib, where it is trapped from further movement.

From the foregoing, it will be recognized that the illustrated embodiment features simple construction, yet is resistant to both the prying and hammer blow attacks that are deficiencies of the prior art. The back of the face plate serves both to hold the rear 36 of the lock cylinder 10, and to brace the cover member 30 against removal.

Having described and illustrated the principles of our invention with reference to an illustrated embodiment, it will be recognized that the embodiment can be modified in arrangement and detail without departing from such principles.

For example, while the invention has been illustrated with reference to a cover member having two arms extending therefrom, a greater or lesser number of arms can be used. Similarly, while the illustrated arms include slots for receiving the fastener clip, holes or other means can alternatively be employed.

Likewise, while the invention has been illustrated as employing a simple wire clip to secure the arms of the cover member as they extend to the back of the lock, a variety of other fastening structures can of course be employed. In some variant embodiments, no clip is needed at all. For example, the arms can be provided with catch members on their ends, and the holes 50 can be positioned so that these catch members are urged towards or away from each other as they pass through the passageway towards holes 50. When the catch members finally exit the holes, they spring back to their natural relation and latch against the back wall.

The foregoing touches on just a few of the variant embodiments that will be obvious to the artisan in view of the foregoing disclosure.

In view of the many possible embodiments to which the principles of our invention may be applied, it should be recognized that the detailed embodiment is illustrative only and should not be taken as limiting the scope of our invention. Rather, we claim as our invention all such embodiments as may come within the scope and spirit of the following claims and equivalents thereto.

We claim:

1. A lock apparatus comprising:

a lock cylinder having a front and a back;

a mounting structure, the mounting structure having a front and a back, the mounting structure defining a recess that extends through an opening in the front of the mounting structure and into which the lock cylinder is positioned, the back of the mounting structure having a rearwardly protruding portion that covers the back of the lock cylinder, the protruding portion having at least one aperture;

a lock cylinder cover received in said opening to hold the lock cylinder within said recess, the lock cylinder cover adjoining the front of the mounting structure and including at least one arm member that passes into said mounting structure towards the back thereof and extends partially through the at least one aperture in the protruding portion; and a fastener clip having two legs and an arm connecting the legs, the legs being positioned adjacent opposite sides of the protruding portion of the back of the face plate, and at least one of the legs engaging the arm member extending through the aperture in the protruding portion to secure the lock cylinder within the recess.

2. The lock apparatus of claim 1 in which the back of the mounting structure includes a feature that secures the clip in place against movement.

3. The lock apparatus of claim 2 which said feature is a nib that protrudes from the back of the mounting structure and over which the arm of the clip is snapped to secure the clip in place.

4. The lock apparatus of claim 1 in which the lock cylinder includes an actuator extending therefrom, the actuator being movable if the lock cylinder is operated by a corresponding key, said actuator being in engagement with a slidable bolt to controllably retract or extend the bolt.

5. The lock apparatus of claim 1 in which the back of the mounting structure forms a frame which covers the back of the lock cylinder, said frame including said recess.

6. The lock apparatus of claim 1 including a bolt slidably mounted in said frame.

* * * * *